US010889876B2

(12) United States Patent
Mun et al.

(10) Patent No.: US 10,889,876 B2
(45) Date of Patent: Jan. 12, 2021

(54) NON-HEAT TREATED WIRE ROD HAVING EXCELLENT COLD WORKABILITY AND MANUFACTURED METHOD THEREFOR

(71) Applicant: POSCO, Pohang-si (KR)

(72) Inventors: Dong-Jun Mun, Pohang-si (KR); Sang-Yoon Lee, Pohang-si (KR); Yong-Kwan Heo, Seoul (KR); Ha-Ni Kim, Seoul (KR)

(73) Assignee: POSCO, Pohang-si (KR)

( * ) Notice: Subject to any disclaimer, the term of this patent is extended or adjusted under 35 U.S.C. 154(b) by 303 days.

(21) Appl. No.: 15/767,345

(22) PCT Filed: Nov. 11, 2016

(86) PCT No.: PCT/KR2016/013028
§ 371 (c)(1),
(2) Date: Apr. 10, 2018

(87) PCT Pub. No.: WO2017/082687
PCT Pub. Date: May 18, 2017

(65) Prior Publication Data

US 2018/0298464 A1 Oct. 18, 2018

(30) Foreign Application Priority Data

Nov. 12, 2015 (KR) ..... 10-2015-0158814

(51) Int. Cl.

| | |
|---|---|
| ***C22C 38/00*** | (2006.01) |
| ***C21D 9/52*** | (2006.01) |
| ***C22C 38/24*** | (2006.01) |
| ***C22C 38/26*** | (2006.01) |
| ***C22C 38/38*** | (2006.01) |
| ***C21D 6/00*** | (2006.01) |
| ***C21D 8/06*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |

(52) U.S. Cl.
CPC ..... *C21D 9/525* (2013.01); *C21D 6/002* (2013.01); *C21D 6/005* (2013.01); *C21D 6/008* (2013.01); *C21D 8/065* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/24* (2013.01); *C22C 38/26* (2013.01); *C22C 38/28* (2013.01); *C22C 38/38* (2013.01); *C21D 2211/005* (2013.01); *C21D 2211/009* (2013.01)

(58) Field of Classification Search
CPC ..... C21D 8/065
See application file for complete search history.

(56) References Cited

U.S. PATENT DOCUMENTS

| | | | | |
|---|---|---|---|---|
| 2004/0000360 | A1 | 1/2004 | Suzuki et al. | |
| 2004/0238075 | A1 | 12/2004 | Kondo | |
| 2012/0263622 | A1* | 10/2012 | Daitoh | C21D 8/065 420/105 |

FOREIGN PATENT DOCUMENTS

| | | | |
|---|---|---|---|
| CN | 1270237 | A | 10/2000 |
| CN | 1338528 | A | 3/2002 |
| CN | 1468971 | A | 1/2004 |
| CN | 1532300 | A | 9/2004 |
| CN | 102071368 | A | 5/2011 |
| CN | 103898417 | A | 7/2014 |
| EP | 0922783 | A1 | 6/1999 |
| EP | 1035222 | A1 | 9/2000 |
| JP | S62-074055 | A | 4/1987 |
| JP | H07-013257 | B2 | 2/1995 |
| JP | H07-305139 | A | 11/1995 |
| JP | H10-195530 | A | 7/1998 |
| JP | 2000-008139 | A | 1/2000 |
| JP | 2002-146480 | A | 5/2002 |
| JP | 2004-137542 | A | 5/2004 |
| KR | 10-2001-0060772 | A | 7/2001 |
| KR | 10-2009-0030544 | A | 3/2009 |
| KR | 10-0940038 | B1 | 2/2010 |
| KR | 10-2015-0022492 | A | 3/2015 |
| KR | 10-2015-0071216 | A | 6/2015 |

OTHER PUBLICATIONS

International Search Report dated Feb. 15, 2017 issued in International Patent Application No. PCT/KR2016/013028 (with English translation).
Chinese Office Action dated Jul. 1, 2019 issued in Chinese Patent Application No. 201680066249.X (with English translation).

* cited by examiner

*Primary Examiner* — Scott R Kastler
(74) *Attorney, Agent, or Firm* — Morgan, Lewis & Bockius LLP

(57) ABSTRACT

Disclosed are a non-quenched and tempered wire rod and a manufacturing method therefor, the non-quenched and tempered wire rod comprising in percentage by weight: 0.15 to 0.30% of C; 0.05 to 0.3% of Si; 1.0 to 2.0% of Mn; 0.5% of less of Cr (except for 0%); 0.02% or less of P; 0.02% or less of S; 0.01 to 0.05% of sol. Al; 0.005 to 0.02% of Nb; 0.05 to 0.2% of V; 0.01% or less of N; Fe as the remainder; and unavoidable impurities, wherein the non-quenched and tempered wire rod satisfies the following formulas 1 and 2, wherein, when the hardness of the wire rod measured in ½d position and in ¼d position in the diameter direction of the wire rod is $Hv,_{1/2d}$(Hv) and $Hv,_{1/4d}$(Hv), respectively (here, d is the diameter of the wire).

$$(Hv,_{1/2d}+Hv,_{1/4d})/2\leq 240 \quad \text{[Formula 1]}$$

$$Hv,_{1/2d}/Hv,_{1/4d}\leq 1.2 \quad \text{[Formula 2]}$$

16 Claims, No Drawings

NON-HEAT TREATED WIRE ROD HAVING EXCELLENT COLD WORKABILITY AND MANUFACTURED METHOD THEREFOR

RELATED APPLICATIONS

This application is the U.S. National Phase under 35 U.S.C. § 371 of International Application No. PCT/KR2016/013028, filed on Nov. 11, 2016 which in turn claims the benefit of Korean Patent Application No. 10-2015-0158814 filed on Nov. 12, 2015, the disclosures of which applications are incorporated by reference herein.

TECHNICAL FIELD

The present disclosure relates to a non-quenched and tempered wire rod having excellent cold workability and a method for manufacturing the same, and more particularly, to a non-quenched and tempered wire rod having excellent cold workability, suitable for use as a material for vehicles or a material for machine components, and a method for manufacturing the same.

BACKGROUND ART

A cold working method has effects of having excellent productivity and a reduction in heat treatment costs, as compared to a hot working method or a machine cutting method, and is thus widely used for manufacturing machine components such as nuts, bolts, or the like.

However, as described above, to manufacture such mechanical components using a cold working method, excellent cold workability of steel is essential. In detail, it is necessary for steel to have low deformation resistance during cold working, and to have excellent ductility. In this case, defective products may be generated because the service life of a tool used during cold working may be reduced if the deformation resistance of steel is high, and because splitting may easily occur during cold working if the ductility of steel is low.

Therefore, in the case of steel for cold working according to the related art, a spheroidizing annealing heat treatment is performed thereon before cold working. In this case, because, during the spheroidizing annealing heat treatment, steel is softened, deformation resistance is reduced, while ductility is improved, and thus, cold workability is improved. However, in this case, because additional costs may be incurred and manufacturing efficiency may be reduced, development of a non-quenched and tempered wire rod capable of securing excellent cold workability without the need for an additional heat treatment has been required.

DISCLOSURE

Technical Problem

An aspect of the present disclosure may provide a non-quenched and tempered wire rod in which excellent strength and cold workability are able to be secured without an additional heat treatment and a method for manufacturing the same.

Technical Solution

According to an aspect of the present inventive concept, a non-quenched and tempered wire rod may include: carbon (C): 0.15 wt % to 0.30 wt %, silicon (Si): 0.05 wt % to 0.3 wt %, manganese (Mn): 1.0 wt % to 2.0 wt %, chrome (Cr): 0.5 wt % or less (excluding 0%), phosphorus (P): 0.02 wt % or less, sulfur (S): 0.02 wt % or less, soluble aluminum (sol. Al): 0.01 wt % to 0.05 wt %, niobium (Nb): 0.005 wt % to 0.02 wt %, vanadium (V): 0.05 wt % to 0.2 wt %, nitrogen (N): 0.01 wt % or less, iron (Fe) as a remainder; and unavoidable impurities, wherein the non-quenched and tempered wire rod satisfies Formula 1 and Formula 2, when hardness of the wire rod, measured in a ½d position and a ¼d position in the diameter direction of the wire rod, are $Hv_{,1/2d}$(Hv) and $Hv_{,1/4d}$(Hv), respectively, $$(Hv_{,1/2d}+Hv_{,1/4d})/2\leq 240 \quad \text{[Formula 1]}$$

$$Hv_{,1/2d}/Hv_{,1/4d}\leq 1.2 \quad \text{[Formula 2]}$$

where d is a diameter of a wire rod.

According to an aspect of the present inventive concept, a method for manufacturing a non-quenched and tempered wire rod, may include: obtaining a billet by billet rolling after heating a bloom at a heating temperature of 1200° C. to 1300° C., the bloom including carbon (C): 0.15 wt % to 0.30 wt %, silicon (Si): 0.05 wt % to 0.3 wt %, manganese (Mn): 1.0 wt % to 2.0 wt %, chrome (Cr): 0.5 wt % or less (excluding 0%), phosphorus (P): 0.02 wt % or less, sulfur (S): 0.02 wt % or less, soluble aluminum (sol. Al): 0.01 wt % to 0.05 wt %, niobium (Nb): 0.005 wt % to 0.02 wt %, vanadium (V): 0.05 wt % to 0.2 wt %, nitrogen (N): 0.01 wt % or less; iron (Fe) as a remainder; and unavoidable impurities, in which a carbon equivalent (Ceq) is 0.5 or more and 0.6 or less, and which satisfies Formula 3 and Formula 4;

obtaining a wire rod by wire rolling under the conditions of a finish rolling temperature of Ae3° C. to (Ae3+50)° C., after reheating the billet at a reheating temperature of 1050° C. to 1250° C.; and performing cooling, after winding the wire rod, $$7.35[C]+1.88[Mn]+0.34[Cr]+0.25[Nb]+0.47[V]\leq 4.5 \quad \text{[Formula 3]}$$

$$0.5\leq 10[Nb]/[V]\leq 2.0 \quad \text{[Formula 4]}$$

where each of [C], [Mn], [Cr], [Nb], and [V] is the content (%) of a corresponding element.

Advantageous Effects

According to an exemplary embodiment in the present disclosure, a non-quenched and tempered wire rod capable of sufficiently suppressing deformation resistance during cold working, even when a spheroidizing annealing heat treatment is omitted, may be provided.

The various features, advantages, and effects of the present disclosure are not limited to the above description, and can be more easily understood while describing a specific embodiment of the present disclosure.

BEST MODE FOR INVENTION

Hereinafter, a non-quenched and tempered wire rod having excellent cold workability according to an aspect of the present disclosure will be described in detail.

The present inventors have examined a wire rod from various aspects to provide a wire rod capable of securing excellent cold workability while having predetermined strength after wire drawing. As a result, by appropriately controlling average hardness of a wire rod and a hardness ratio of a center segregation portion and a non-segregation portion of a wire rod, the present inventors have found that a wire rod in which cold workability is not deteriorated while having predetermined strength after wire drawing can be provided, thereby completing the present disclosure.

A wire rod of the present disclosure satisfies Formula 1 and Formula 2, when hardness of the wire rod measured in a ½d position and a ¼d position (here, d is a diameter of a wire rod) in the diameter direction of the wire rod are $Hv,_{1/2d}$(Hv) and $Hv,_{1/4d}$(Hv), respectively. If the wire rod does not satisfy Formula 1, strength after wire drawing is significant, so cold workability may be deteriorated. If the wire rod does not satisfy Formula 2, cracking may occur in the wire rod during cold forging after wire drawing. Thus, cold workability may be deteriorated.

$$(Hv,_{1/2d}+Hv,_{1/4d})/2\leq 240 \quad \text{[Formula 1]}$$

$$Hv,_{1/2d}/Hv,_{1/4d}\leq 1.2 \quad \text{[Formula 2]}$$

In order to satisfy Formula 1 and Formula 2, a wire rod of the present disclosure may have the following alloy composition and composition range. It is noted in advance that the content of each element described below is based on weight, unless otherwise specified.

First, an alloy composition and composition range of a non-quenched and tempered wire rod will be described in detail.

Carbon (C): 0.15% to 0.30%

Carbon serves to increase the strength of a wire rod. In the present disclosure, in order to realize the effect described above, carbon is preferably included in an amount of 0.15% or more, and more preferably, included in an amount of 0.16% or more. However, if the content of carbon is excessive, deformation resistance of steel may rapidly increase, and thus, a problem in which cold workability is deteriorated may occur. Thus, an upper limit of the content of carbon is preferably 0.3%, more preferably 0.29%.

Silicon (Si): 0.05% to 0.3%

Silicon is an element useful as a deoxidizer. In the present disclosure, in order to realize the effect described above, silicon is preferably included in an amount of 0.05% or more. However, if the content of silicon is excessive, deformation resistance of steel may rapidly increase through solid solution strengthening, and thus, a problem in which cold workability is deteriorated may occur. Thus, an upper limit of the content of silicon is preferably 0.3%, more preferably 0.25%.

Manganese (Mn): 1.0% to 2.0%

Manganese is an element useful as a deoxidizer and a desulfurizing agent. In the present disclosure, in order to realize the effect described above, manganese is preferably included in an amount of 1.0% or more, and more preferably, included in an amount of 1.1% or more. However, if the content of manganese is excessive, the strength of steel itself is significantly increased, and thus, a problem in which cold workability is deteriorated may occur. Thus, an upper limit of the content of manganese is preferably 2.0%, more preferably 1.8%.

Chromium (Cr): 0.5% or Less (Excluding 0%)

Chromium serves to promote transformation of ferrite and pearlite during hot rolling. In addition, while the strength of steel itself is not increased more than necessary, a carbide in steel is precipitated and an amount of solid carbon is reduced, thereby contributing to a reduction in dynamic deformation aging caused by solid carbon. However, if the content of chromium is excessive, the strength of steel itself is significantly increased, so deformation resistance of steel rapidly increases. Thus, a problem in which cold workability is deteriorated may occur. The content of chromium is preferably 0.5% or less (excluding 0%), more preferably 0.05% to 0.45%.

Phosphorus (P): 0.02% or Less

Phosphorus, an impurity which is inevitably contained, is segregated in grain boundaries to reduce toughness of steel, and is an element mainly responsible for a decrease in delayed fracture resistance. Thus, the content of phosphorus is preferably controlled to be as low as possible. Theoretically, it is advantageous to control the content of phosphorus to be 0%, but phosphorus is inevitably contained in a manufacturing process. Thus, it is important to manage an upper limit of phosphorus. In the present disclosure, the upper limit of the content of phosphorus is managed to be 0.02%.

Sulfur (S): 0.02% or Less

Sulfur, an impurity which is inevitably contained, is segregated in grain boundaries to significantly reduce ductility, and is an element mainly responsible for a deterioration of cold forgeability, delayed fracture resistance and stress relaxation characteristics by forming sulfide (an MnS inclusion) in steel. Thus, the content of sulfur is preferably controlled to be as low as possible. Theoretically, it is advantageous to control the content of sulfur to be 0%, but sulfur is inevitably contained in a manufacturing process. Thus, it is important to manage an upper limit of sulfur. In the present disclosure, the upper limit of the content of sulfur is managed to be 0.02%, more preferably 0.01%, further more preferably 0.009%, most preferably 0.008%.

Soluble Aluminum (Sol. Al): 0.01% to 0.05%

Soluble aluminum is an element useful as a deoxidizer. In the present disclosure, in order to realize the effect described above, soluble aluminum is preferably included in an amount of 0.01% or more, more preferably, included in an amount of 0.015% or more, and further more preferably, included in an amount of 0.02% or more. However, if the content of soluble aluminum exceeds 0.05%, by the formation of AlN, an austenite grain refinement effect is increased, so cold workability may be lowered. Thus, in the present disclosure, an upper limit of the content of soluble aluminum is managed to be 0.05%.

Niobium (Nb): 0.005% to 0.02%

Niobium, an element serving to limit movement of austenite and ferrite to a grain boundary by forming a carbonitride, is included in an amount of 0.005% or more. However, the carbonitride acts as a point of fracture, and thus may reduce impact toughness, in detail, low temperature impact toughness. Thus, niobium is preferably added within a solubility limit. Furthermore, if the content of niobium is excessive, a problem in which a concentration exceeds a solid solution limit and a coarse precipitate is formed may occur. Thus, the content of niobium is preferably limited to 0.02% or less, more preferably to 0.018% or less.

Vanadium (V): 0.05% to 0.2%

Vanadium, an element serving to limit movement of austenite and ferrite to a grain boundary by forming a carbonitride, in a manner similar to niobium, is included in an amount of 0.05% or more. However, the carbonitride acts as a point of fracture, and thus may reduce impact toughness, in detail, low temperature impact toughness. Thus, vanadium is preferably added within a solubility limit. Thus, the content of vanadium is preferably limited to 0.2% or less, more preferably to 0.18% or less.

Nitrogen (N): 0.01% or Less

Nitrogen is an impurity which is inevitably contained. If the content of nitrogen is excessive, an amount of solid nitrogen increases, so deformation resistance of steel rapidly increases. Thus, a problem in which cold workability is deteriorated may occur. Theoretically, it is advantageous to control the content of nitrogen to be 0%, but nitrogen is inevitably contained in a manufacturing process. Thus, it is important to manage an upper limit of nitrogen. In the present disclosure, the upper limit of the content of nitrogen is managed to be 0.01%, more preferably managed to be 0.008%, further more preferably managed to be 0.007%.

The remainder of an alloy composition is iron (Fe). In addition, the non-quenched and tempered wire rod of the present disclosure may include other impurities which may be included in an industrial production process of steel according to the related art. These impurities may be known to any person skilled in the art, and therefore the type and content of the impurities are not particularly limited in the present disclosure.

However, since titanium (Ti) corresponds to a representative impurity, a content of which is to be suppressed in order to obtain the effect of the present disclosure, a brief description thereof will be provided below.

Titanium (Ti): 0.005% or Less

Titanium, a carbonitride forming element, may form a carbonitride at a higher temperature, as compared to Nb and V. If titanium is included in steel, it may be advantageous to fix C and N. However, in this case, Nb and/or V is precipitated using Ti carbonitrides as a nucleus, and thus a large amount of coarse carbonitrides are formed in a base, so cold workability may be deteriorated. Thus, it is important to manage an upper limit of titanium. In the present disclosure, the upper limit of the content of titanium is preferably managed to be 0.005%, more preferably managed to be 0.004%.

For example, a carbon equivalent (Ceq) of a wire rod of the present disclosure may be 0.5 or more and 0.6 or less. Here, the carbon equivalent (Ceq) may be defined by Equation 1. If the carbon equivalent (Ceq) is less than 0.5 or exceeds 0.6, it may be difficult to secure target strength.

$$Ceq=[C]+[Si]/9+[Mn]/5+[Cr]/12 \quad \text{[Equation 1]}$$

Where, each of [C], [Si], [Mn], and [Cr] refers to the content (%) of a corresponding element.

For example, the contents of C, Mn, Cr, Nb, and V may satisfy Formula 3, If the contents thereof do not satisfy Formula 3, by segregation in a center portion, a difference in hardness between a center segregation portion and a non-segregation portion of a wire rod rapidly increases, so possibility of internal cracking during a cold forging process rapidly increases. Thus, cold workability may be deteriorated.

$$7.35[C]+1.88[Mn]+0.34[Cr]+0.25[Nb]+0.47[V]\leq 4.5 \quad \text{[Formula 3]}$$

Where, each of [C], [Mn], [Cr], [Nb], and [V] refers to the content (%) of a corresponding element.

For example, the contents of Nb and V may satisfy Formula 4. The inventors confirmed that formation of coarse Nb and V composite carbonitrides was suppressed, when the contents of Nb and V satisfy Formula 4. If the contents of Nb and V do not satisfy Formula 4, Nb and V carbonitrides are not sufficiently solidified during billet reheating and are coarsely precipitated in a base during a wire rod manufacturing process, so cold workability may be deteriorated. A lower limit of a value of 10[Nb]/[V] is more preferably 0.6, further more preferably 0.7. An upper limit of a value of 10[Nb]/[V] is more preferably 1.5, further more preferably 1.2.

$$0.5\leq 10[Nb]/[V]\leq 2.0 \quad \text{[Formula 4]}$$

Where, each of [Nb] and [V] refers to the content (%) of a corresponding element.

For example, the non-quenched and tempered wire rod includes a carbonitride including Nb and/or V, and an average equivalent circular diameter of the carbonitride may be 70 nm or less. If the average equivalent circular diameter of the carbonitride exceeds 70 nm, the carbonitrides may act as a point of fracture at a center segregation portion. Here, the carbonitride refers to a precipitate including carbon and/or nitrogen.

For example, the number per unit area of a carbonitride in which an average equivalent circular diameter is 80 nm or more, of the carbonitride including Nb and/or V, may be 5 per 1 $\mu m^2$ or less. If the number per unit area of the carbonitride in which an average equivalent circular diameter is 80 nm or more exceeds 5 per 1 $\mu m^2$, it may be difficult to secure target cold workability.

Meanwhile, in the present disclosure, a method of measuring an average equivalent circular diameter of the carbonitride including Nb and/or V is not particularly limited, but the following method may be used by way of example. A non-quenched and tempered wire rod may be cut in a direction perpendicular to a longitudinal direction, and then an image of a cross-section may be captured at ×1,000 magnification using a Field Emission Scanning Electron Microscope (FE-SEM) in a ¼d position (here, d refers to a diameter of a non-quenched and tempered wire rod), and a composition of each precipitate is analyzed using an Electron Probe Micro-Analyzer (EPMA), and a type thereof is classified. Then, the type thereof is analyzed, and thus, the number of a coarse carbonitride in which an average equivalent circular diameter is 80 nm or more, of a carbonitride including Nb and/or V, can be calculated.

For example, a wire rod of the present disclosure may include ferrite and pearlite as a microstructure, more preferably, ferrite of 30% or more (excluding 100%) and pearlite of 70% or less (excluding 0%) in an area fraction. When the structure described above is secured, it has the advantage of securing excellent cold workability and securing excellent strength after a proper wire drawing.

In addition, for example, an average grain size of ferrite may be 5 μm to 25 μm, more preferably 10 μm to 20 μm. If an average grain size of ferrite is less than 5 μm, due to grain refinement, strength increases, cold workability may be reduced. On the other hand, the average grain size of ferrite exceeds 25 μm, strength may decrease.

In addition, for example, a standard deviation of a grain size of ferrite may be 5 μm or less (including 0 μm), more preferably 3 μm or less (including 0 μm). If the standard deviation of a grain size of ferrite exceeds 5 μm, coarse ferrite becomes a point of brittle fracture, so toughness and workability of steel may be deteriorated.

Meanwhile, an average grain size and a standard deviation of a grain size of pearlite, formed together with ferrite, is not particularly limited, because the average grain size and the standard deviation of a grain size of pearlite are influenced by the average grain size and the standard deviation of a grain size of ferrite. Here, a grain size refers to an equivalent circular diameter of particles detected by observing a cross-section in a longitudinal direction of a wire rod.

For example, a wire rod of the present disclosure has an advantage of having excellent ductility with a cross-section reduction rate (RA) of 70% or more in a state of a wire rod.

For example, when a wire rod of the present disclosure is drawn in a drawing amount (D) of 5% to 25%, hardness of the wire rod after wire drawing may satisfy Formula 5. If the hardness of the wire rod after wire drawing does not satisfy Formula 5, an increase in strength caused by work hardening is significant, so cold workability may rapidly decrease.

$$Hv,_1-10 \leq (Hv,_{D,1/2d}+Hv,_{D,1/4d})/2 \leq Hv,_1+10 \quad \text{[Formula 5]}$$

Where, $Hv,_1$ refers to "$(Hv,_{1/2D}+Hv,_{1/4D})/2+85.45\times\{1-\exp(-D/11.41)\}$", and $Hv,_{D,1/2d}$ and $Hv,_{D,1/4d}$ refer to hardness of the wire rod measured in a ½d position and a ¼d position in the diameter direction of the wire rod after wire drawing, respectively.

The wire rod of the present disclosure for drawing described above may be manufactured in various methods, and a method for manufacturing the same is not particularly limited. However, as an exemplary example, the wire rod may be manufactured by the following method.

Hereinafter, a method for manufacturing a non-quenched and tempered wire rod having excellent cold workability, another aspect of the present disclosure, will be described in detail.

First, a bloom satisfying the composition is heated, and is then billet-rolled to obtain a billet.

A heating temperature of the bloom is preferably 1200° C. to 1300° C., more preferably 1220° C. to 1280° C. If the heating temperature of the bloom is lower than 1200° C., hot deformation resistance may be increased. On the other hand, if the heating temperature of the bloom exceeds 1300° C., by coarsening of austenite, ductility may be deteriorated.

For example, when the bloom is heated, the retention time at heating temperature may be equal to 4 hours or more. If the retention time is less than 4 hours, a homogenization treatment may be insufficient. Meanwhile, when the retention time at heating temperature is longer, homogenization may be advantageously performed, so a segregation may be easily reduced. In the present disclosure, an upper limit of the retention time is not particularly limited.

Next, the billet is reheated, and is then wire rolled to obtain a non-quenched and tempered wire rod.

A reheating temperature of the billet is preferably 1050° C. to 1250° C., more preferably 1100° C. to 1200° C. If the reheating temperature of the billet is less than 1050° C., hot deformation resistance is increased, so productivity may be reduced. On the other hand, if the heating temperature exceeds 1250° C., a ferrite grain may be significantly coarse, so ductility may be lowered.

For example, when the billet is reheated, the retention time at reheating temperature may be equal to 80 minutes or more. If the retention time is mess than 80 minutes, a homogenization treatment may be insufficient. Meanwhile, in the case that the retention time at reheating temperature is longer, homogenization of segregation promoting elements may be advantageously performed. In the present disclosure, an upper limit of the retention time is not particularly limited.

During wire rolling, a finish rolling temperature is preferably Ae3° C. to (Ae3+50)° C. If the finish rolling temperature is less than Ae3° C., due to a temperature deviation of a center portion and a surface part of a wire rod, a size deviation of the particles of a ferrite grain may occur. Due to an increase in strength by ferrite grain refinement, deformation resistance may be increased. On the other hand, if the finish rolling temperature exceeds Ae3+50° C., a ferrite grain is significantly coarse, so toughness may be lowered. For reference, Ae3 can be calculated from Equation 2. For reference, here, a finish rolling temperature refers to a surface temperature of a slab at a finish rolling start point, and a surface temperature of the slab after finish rolling starts may be increased more than the finish rolling temperature due to a heat effect. In the present disclosure, the surface temperature of the slab after finish rolling starts is not particularly limited.

$$Ae3(^\circ C.)=930-185\sqrt{[C]}+60[Si]-25[Mn]-500[P]+12[Cr]-200[Al]+100[V]-400[Ti] \quad \text{[Equation 2]}$$

Where, each of [C], [Si], [Mn], [P], [Cr], [Al], [V], and [Ti] refers to the content (%) of a corresponding element.

Thereafter, the non-quenched and tempered wire rod is wound, and is then cooled.

A winding temperature of a non-quenched and tempered wire rod may be 750° C. to 900° C., more preferably 800° C. to 850° C. If the winding temperature is less than 750° C., martensite in a surface layer, generated during cooling, is not recovered by heat recuperation, while tempered martensite is generated, so steel becomes hard and brittle. Thus, cold workability may be lowered. On the other hand, if the winding temperature exceeds 900° C., a thick scale is formed on a surface, so trouble may easily occur during descaling, and the cooling time is longer and thus productivity may be lowered.

A cooling rate during cooling of a non-quenched and tempered wire rod may be 0.1° C./sec to 1° C./sec, preferably 0.3° C./sec to 0.8° C./sec. In this case, the cooling rate described above is provided to stably form a ferrite and pearlite composite structure. If the cooling rate is less than 0.1° C./sec, lamellar spacing in a pearlite structure is widened, so ductility may be insufficient. If the cooling rate exceeds 1° C./sec, a ferrite fraction may be insufficient, so cold workability may be deteriorated.

MODE FOR INVENTION

Hereinafter, the present disclosure will be described in more detail through examples. However, the description of these examples is for the purpose of illustrating the practice of the present disclosure, and the present disclosure is not limited by the description of these examples. The scope of the present disclosure is determined by the matters described in the appended claims and the matters reasonably deduced therefrom.

A bloom having the composition described in Table 1 was heated at 1250° C. for 5 hours, and was then billet rolled under a finish rolling temperature condition of 1150° C. to obtain a billet. Thereafter, the billet was reheated at 1150° C. for 2 hours, and was then wire rolled with a wire diameter of 20 mm to manufacture a non-quenched and tempered wire rod. In the case of Comparative Example 1, finish rolling was performed at a finish rolling temperature of 770° C. In the case of other Examples, finish rolling was performed at a finish rolling temperature of 850° C. Thereafter, winding was performed at a temperature of 800° C., and cooling was performed at a rate of 0.5° C./sec. Thereafter, a microstructure of the wire rod, having been cooled, was observed using a FE-SEM, and an equivalent circular diameter of a carbonitride, and the like were calculated, and then hardness was measured in a ½d position and a ¼d position in the diameter direction of the wire rod. A result thereof is illustrated in Table 2.

In addition, cold workability of a wire rod, having been cooled, was evaluated, and is illustrated in Table 2. A notch compression specimen was subjected to a compression test in which true strain is 0.7, and cold workability was evaluated considering whether cracking occurred. If cracking did not occur, cold workability was evaluated as "GO". If cracking occurred, cold workability was evaluated as "NG".

TABLE 1

| STEEL | ALLOY COMPOSITION (WT %) C | Si | Mn | P | S | Cr | sol. Al | Nb | V | N | Ti | ①* | ②** | ③*** |
|---|---|---|---|---|---|---|---|---|---|---|---|---|---|---|
| INVENTIVE STEEL 1 | 0.16 | 0.16 | 1.45 | 0.011 | 0.0042 | 0.41 | 0.03 | 0.009 | 0.12 | 0.0045 | 0.003 | 0.50 | 4.10 | 0.75 |
| INVENTIVE STEEL 2 | 0.18 | 0.17 | 1.41 | 0.010 | 0.0055 | 0.35 | 0.02 | 0.012 | 0.15 | 0.0044 | 0.004 | 0.51 | 4.17 | 0.8 |
| INVENTIVE STEEL 3 | 0.19 | 0.18 | 1.38 | 0.012 | 0.0053 | 0.31 | 0.04 | 0.010 | 0.11 | 0.0042 | 0.001 | 0.51 | 4.15 | 0.91 |
| INVENTIVE STEEL 4 | 0.21 | 0.14 | 1.42 | 0.011 | 0.0061 | 0.25 | 0.03 | 0.011 | 0.13 | 0.0053 | 0.002 | 0.53 | 4.36 | 0.85 |
| INVENTIVE STEEL 5 | 0.24 | 0.17 | 1.37 | 0.012 | 0.0043 | 0.23 | 0.04 | 0.009 | 0.11 | 0.0052 | 0.003 | 0.55 | 4.47 | 0.82 |
| INVENTIVE STEEL 6 | 0.27 | 0.18 | 1.26 | 0.011 | 0.0057 | 0.16 | 0.03 | 0.008 | 0.10 | 0.0048 | 0.002 | 0.56 | 4.46 | 0.80 |
| INVENTIVE STEEL 7 | 0.28 | 0.21 | 1.20 | 0.010 | 0.0052 | 0.14 | 0.02 | 0.009 | 0.08 | 0.0040 | 0.004 | 0.56 | 4.40 | 1.12 |
| INVENTIVE STEEL 8 | 0.29 | 0.19 | 1.17 | 0.011 | 0.0064 | 0.13 | 0.03 | 0.008 | 0.07 | 0.0037 | 0.001 | 0.56 | 4.44 | 1.14 |
| INVENTIVE STEEL 9 | 0.19 | 0.21 | 1.59 | 0.011 | 0.0056 | 0.18 | 0.03 | 0.006 | 0.11 | 0.0054 | 0.005 | 0.54 | 4.49 | 0.55 |
| COMPARATIVE STEEL 1 | 0.15 | 0.18 | 1.75 | 0.010 | 0.0055 | 0.21 | 0.03 | 0.007 | 0.17 | 0.0055 | 0.015 | 0.54 | 4.55 | 0.41 |
| COMPARATIVE STEEL 2 | 0.17 | 0.17 | 1.68 | 0.012 | 0.0062 | 0.19 | 0.02 | 0.006 | 0.13 | 0.0053 | 0.012 | 0.54 | 4.54 | 0.45 |
| COMPARATIVE STEEL 3 | 0.18 | 0.15 | 1.63 | 0.013 | 0.0053 | 0.23 | 0.04 | 0.002 | 0.20 | 0.0047 | 0.010 | 0.54 | 4.56 | 0.1 |
| COMPARATIVE STEEL 4 | 0.22 | 0.16 | 1.59 | 0.010 | 0.0062 | 0.17 | 0.03 | 0.007 | 0.16 | 0.0045 | 0.008 | 0.57 | 4.74 | 0.44 |
| COMPARATIVE STEEL 5 | 0.26 | 0.17 | 1.52 | 0.011 | 0.0063 | 0.25 | 0.04 | 0.005 | 0.12 | 0.0052 | 0.007 | 0.61 | 4.91 | 0.42 |
| COMPARATIVE STEEL 6 | 0.28 | 0.18 | 1.48 | 0.012 | 0.0051 | 0.27 | 0.02 | 0.002 | 0.07 | 0.0046 | 0.004 | 0.62 | 4.97 | 0.29 |
| COMPARATIVE STEEL 7 | 0.32 | 0.20 | 1.32 | 0.011 | 0.0059 | 0.29 | 0.03 | 0.002 | 0.06 | 0.0048 | 0.003 | 0.63 | 4.96 | 0.33 |
| COMPARATIVE STEEL 8 | 0.35 | 0.22 | 1.24 | 0.010 | 0.0047 | 0.31 | 0.02 | 0.001 | 0.05 | 0.0054 | 0.006 | 0.65 | 5.03 | 0.2 |

*① = [C] + [Si]/9 + [Mn]/5 + [Cr]/12
**② = 7.35[C] + 1.88[Mn] + 0.34[Cr] + 0.25[Nb] + 0.47[V],
***③ = 10[Nb]/[V]

TABLE 2

| STEEL | MICRO-STRUCTURE* | FERRITE FRACTION (AREA %) | FERRITE AVERAGE GRAIN SIZE (μm) | FERRITE GRAIN SIZE STANDARD DEVIATION (μm) | ①** | ②*** | COLD WORKABILITY | NOTE |
|---|---|---|---|---|---|---|---|---|
| INVENTIVE STEEL 1 | F + P | 55.4 | 14 | 1.9 | 214.2 | 1.04 | GO | INVENTIVE EXAMPLE 1 |
| INVENTIVE STEEL 2 | F + P | 52.8 | 13 | 2.1 | 230.0 | 1.08 | GO | INVENTIVE EXAMPLE 2 |
| INVENTIVE STEEL 3 | F + P | 51.5 | 16 | 2.4 | 220.4 | 1.07 | GO | INVENTIVE EXAMPLE 3 |
| INVENTIVE STEEL 4 | F + P | 48.7 | 11 | 2.8 | 231.4 | 1.10 | GO | INVENTIVE EXAMPLE 4 |
| INVENTIVE STEEL 5 | F + P | 46.8 | 12 | 2.2 | 233.2 | 1.18 | GO | INVENTIVE EXAMPLE 5 |
| INVENTIVE STEEL 6 | F + P | 43.6 | 11 | 3.0 | 230.8 | 1.17 | GO | INVENTIVE EXAMPLE 6 |
| INVENTIVE STEEL 7 | F + P | 43.1 | 10 | 2.7 | 229.9 | 1.12 | GO | INVENTIVE EXAMPLE 7 |
| INVENTIVE STEEL 8 | F + P | 42.3 | 9 | 2.9 | 229.2 | 1.13 | GO | INVENTIVE EXAMPLE 8 |
| INVENTIVE STEEL 9 | F + P | 51.3 | 8 | 6.8 | 251.5 | 1.31 | GO | COMPARATIVE EXAMPLE 1 |
| COMPARATIVE STEEL 1 | F + P | 56.7 | 18 | 5.1 | 236.9 | 1.23 | GO | COMPARATIVE EXAMPLE 2 |
| COMPARATIVE STEEL 2 | F + P | 53.2 | 19 | 5.4 | 231.2 | 1.22 | GO | COMPARATIVE EXAMPLE 3 |
| COMPARATIVE STEEL 3 | F + P | 52.5 | 17 | 5.3 | 246.7 | 1.24 | GO | COMPARATIVE EXAMPLE 4 |
| COMPARATIVE STEEL 4 | F + P | 48.1 | 13 | 5.6 | 253.0 | 1.29 | GO | COMPARATIVE EXAMPLE 5 |

TABLE 2-continued

| STEEL | MICRO-STRUCTURE* | FERRITE FRACTION (AREA %) | FERRITE AVERAGE GRAIN SIZE (μm) | FERRITE GRAIN SIZE STANDARD DEVIATION (μm) | ①** | ②*** | COLD WORKABILITY | NOTE |
|---|---|---|---|---|---|---|---|---|
| COMPARATIVE STEEL 5 | F + P | 44.0 | 14 | 5.5 | 241.6 | 1.34 | GO | COMPARATIVE EXAMPLE 6 |
| COMPARATIVE STEEL 6 | F + P | 43.4 | 15 | 5.2 | 238.4 | 1.37 | GO | COMPARATIVE EXAMPLE 7 |
| COMPARATIVE STEEL 7 | F + P | 38.7 | 16 | 6.1 | 242.6 | 1.35 | GO | COMPARATIVE EXAMPLE 8 |
| COMPARATIVE STEEL 8 | F + P | 34.1 | 12 | 5.4 | 248.3 | 1.41 | GO | COMPARATIVE EXAMPLE 9 |

*F REFERS TO FERRITE, AND P REFERS TO PEARLITE

**① = $(Hv_{,1/2d} + Hv_{,1/4d})/2$

***② = $Hv_{,1/2d}/Hv_{,1/4d}$

Thereafter, a drawing amount of each of 10%, 20%, and 30% was applied to each wire rod, and a steel wire was manufactured. A hardness of each steel wire, having been manufactured, was measured in a ½d position and a ¼d position in the diameter direction, and cold workability was evaluated. A result thereof is illustrated in Table 3.

TABLE 3

| STEEL | $(Hv_{D,1/2d} + Hv_{D,1/4d})/2$ 10% | 20% | 30% | COLD WORKABILITY 10% | 20% | 30% | NOTE |
|---|---|---|---|---|---|---|---|
| INVENTIVE STEEL 1 | 264.0 | 277.2 | 286.0 | GO | GO | GO | INVENTIVE EXAMPLE 1 |
| INVENTIVE STEEL 2 | 279.8 | 293.0 | 301.8 | GO | GO | GO | INVENTIVE EXAMPLE 2 |
| INVENTIVE STEEL 3 | 270.2 | 283.4 | 292.2 | GO | GO | GO | INVENTIVE EXAMPLE 3 |
| INVENTIVE STEEL 4 | 281.3 | 294.5 | 303.3 | GO | GO | GO | INVENTIVE EXAMPLE 4 |
| INVENTIVE STEEL 5 | 283.1 | 296.3 | 305.1 | GO | GO | GO | INVENTIVE EXAMPLE 5 |
| INVENTIVE STEEL 6 | 280.7 | 293.9 | 302.7 | GO | GO | GO | INVENTIVE EXAMPLE 6 |
| INVENTIVE STEEL 7 | 279.7 | 293.0 | 301.8 | GO | GO | GO | INVENTIVE EXAMPLE 7 |
| INVENTIVE STEEL 8 | 279.1 | 292.3 | 301.1 | GO | GO | GO | INVENTIVE EXAMPLE 8 |
| INVENTIVE STEEL 9 | 293.5 | 310.4 | 321.6 | GO | GO | NG | COMPARATIVE EXAMPLE 1 |
| COMPARATIVE STEEL 1 | 288.8 | 292.4 | 312.3 | GO | GO | NG | COMPARATIVE EXAMPLE 2 |
| COMPARATIVE STEEL 2 | 285.1 | 294.7 | 304.3 | GO | GO | NG | COMPARATIVE EXAMPLE 3 |
| COMPARATIVE STEEL 3 | 290.6 | 308.2 | 318.7 | GO | GO | NG | COMPARATIVE EXAMPLE 4 |
| COMPARATIVE STEEL 4 | 299.2 | 311.5 | 322.9 | GO | GO | NG | COMPARATIVE EXAMPLE 5 |
| COMPARATIVE STEEL 5 | 297.5 | 302.1 | 313.5 | GO | NG | NG | COMPARATIVE EXAMPLE 6 |
| COMPARATIVE STEEL 6 | 288.7 | 293.9 | 309.2 | GO | NG | NG | COMPARATIVE EXAMPLE 7 |
| COMPARATIVE STEEL 7 | 290.6 | 307.1 | 316.6 | GO | NG | NG | COMPARATIVE EXAMPLE 8 |
| COMPARATIVE STEEL 8 | 296.1 | 306.8 | 318.1 | GO | NG | NG | COMPARATIVE EXAMPLE 9 |

As can be seen from Table 3, in the case of Inventive Examples 1 to 8 satisfying an alloy composition and manufacturing conditions proposed in the present disclosure, an average hardness of a wire rod and a hardness ratio of a center segregation portion and a non-segregation portion of a wire rod satisfy a range proposed in the present disclosure and it can be seen that cold workability is excellent. On the other hand, in the case of Comparative Examples 1 to 9, a hardness ratio of a center segregation portion and a non-segregation portion of a wire rod exceeds a range proposed in the present disclosure. Thus, cracking occurred inside during cold forging after wire drawing, and cold workability was inferior, as compared to an Inventive Steel.

The invention claimed is:

1. A non-heat treated wire rod, comprising:

carbon (C): 0.15 wt % to 0.30 wt %, silicon (Si): 0.05 wt % to 0.3 wt %, manganese (Mn): 1.0 wt % to 2.0 wt %, chrome (Cr): 0.45 wt % or less (excluding 0%), phosphorus (P): 0.02 wt % or less, sulfur (S): 0.02 wt % or less, soluble aluminum (sol. Al): 0.01 wt % to 0.05 wt %, niobium (Nb): 0.005 wt % to 0.02 wt %, vanadium (V): 0.05 wt % to 0.2 wt %, nitrogen (N): 0.008 wt % or less, iron (Fe) as a remainder; and unavoidable impurities, wherein the non-heat treated wire rod satisfies Formula 1 and Formula 2, when hardness of the wire rod, measured in a ½d position and a ¼d position in the diameter direction of the wire rod, are $Hv,_{1/2d}$(Hv) and $Hv,_{1/4d}$(Hv), respectively, $$(Hv,_{1/2d}+Hv,_{1/4d})/2\leq 240 \quad \text{[Formula 1]}$$

$$Hv,_{1/2d}/Hv,_{1/4d}\leq 1.2 \quad \text{[Formula 2]}$$

where d is a diameter of a wire rod.

2. The non-heat treated wire rod of claim 1, wherein the unavoidable impurities include titanium (Ti), and are suppressed to 0.005 wt % or less of Ti.

3. The non-heat treated wire rod of claim 1, wherein the non-heat treated wire rod includes a carbonitride having Nb and/or V, and an average equivalent circular diameter of the carbonitride is 5 nm to 70 nm.

4. The non-heat treated wire rod of claim 3, wherein the number per unit area of a carbonitride, of the carbonitride, having an average equivalent circular diameter of 80 nm or more, is 5 per 1 $\mu m^2$ or less.

5. The non-heat treated wire rod of claim 1, wherein a carbon equivalent (Ceq) is 0.5 or more and 0.6 or less.

6. The non-heat treated wire rod of claim 1, wherein the non-heat treated wire rod satisfies Formula 3, $$7.35[C]+1.88[Mn]+0.34[Cr]+0.25[Nb]+0.47[V]\leq 4.5 \quad \text{[Formula 3]}$$

where each of [C], [Mn], [Cr], [Nb], and [V] is the content (%) of a corresponding element.

7. The non-heat treated wire rod of claim 1, wherein the non-heat treated wire rod satisfies Formula 4, $$0.5\leq 10[Nb]/[V]\leq 2.0 \quad \text{[Formula 4]}$$

where each of [Nb] and [V] is the content (%) of a corresponding element.

8. The non-heat treated wire rod of claim 1, wherein the non-heat treated wire rod includes ferrite and pearlite, as a microstructure.

9. The non-heat treated wire rod of claim 1, including ferrite of 30 area % or more (excluding 100 area %) and pearlite of 70 area % or less (excluding 0 area %), as a microstructure.

10. The non-heat treated wire rod of claim 8, wherein an average grain size of the ferrite is 5 μm to 25 μm.

11. The non-heat treated wire rod of claim 1, wherein, during wire drawing in a drawing amount (D) of 5% to 25%, hardness of the wire rod after the wire drawing satisfies Formula 5, $$Hv,_1-10\leq(Hv,_{D,1/2d}+Hv,_{D,1/4d})/2\leq Hv,_1+10 \quad \text{[Formula 5]}$$

where $Hv,_1$ is "$(Hv,_{1/2d}+Hv,_{1/4d})/2+85.45\times\{1-\exp(-D/11.41)\}$", and $Hv,_{D,1/2d}$ and $Hv,_{D,1/4d}$ are hardness of the wire rod, measured in a ½d position and a ¼d position in the diameter direction of the wire rod after the wire drawing, respectively.

12. A method for manufacturing a non-heat treated wire rod, comprising:

obtaining a billet by billet rolling after heating a bloom at a heating temperature of 1200° C. to 1300° C., the bloom including carbon (C): 0.15 wt % to 0.30 wt %, silicon (Si): 0.05 wt % to 0.3 wt %, manganese (Mn): 1.0 wt % to 2.0 wt %, chrome (Cr): 0.45 wt % or less (excluding 0%), phosphorus (P): 0.02 wt % or less, sulfur (S): 0.02 wt % or less, soluble aluminum (sol. Al): 0.01 wt % to 0.05 wt %, niobium (Nb): 0.005 wt % to 0.02 wt %, vanadium (V): 0.05 wt % to 0.2 wt %, nitrogen (N): 0.008 wt % or less; iron (Fe) as a remainder; and unavoidable impurities, in which a carbon equivalent (Ceq) is 0.5 or more and 0.6 or less, and which satisfies Formula 3 and Formula 4;

obtaining a wire rod by wire rolling under the conditions of a finish rolling temperature of Ae3° C. to (Ae3+50° C.), after reheating the billet at a reheating temperature of 1050° C. to 1250° C.; and performing cooling, after winding the wire rod, $$7.35[C]+1.88[Mn]+0.34[Cr]+0.25[Nb]+0.47[V]\leq 4.5 \quad \text{[Formula 3]}$$

$$0.5\leq 10[Nb]/[V]\leq 2.0 \quad \text{[Formula 4]}$$

where each of [C], [Mn], [Cr], [Nb], and [V] is the content (%) of a corresponding element, and wherein, during the winding, a winding temperature is 750° C. to 900° C.

13. The method for manufacturing a non-heat treated wire rod of claim 12, wherein the unavoidable impurities include titanium (Ti), and are suppressed to 0.005 wt % or less of Ti.

14. The method for manufacturing a non-heat treated wire rod of claim 12, wherein, during the heating of the bloom, retention time at a heating temperature is 4 hours or more.

15. The method for manufacturing a non-heat treated wire rod of claim 12, wherein, during the reheating of the billet, retention time at a reheating temperature is 80 minutes or more.

16. The method for manufacturing a non-heat treated wire rod of claim 12, wherein, during the cooling, a cooling rate is 0.1° C./sec to 1° C./sec.

* * * * *